United States Patent [19]

Yutori et al.

[11] Patent Number: 4,533,401

[45] Date of Patent: Aug. 6, 1985

[54] PROCESS FOR PRODUCING STEEL WIRE OR RODS OF HIGH DUCTILITY AND STRENGTH

[75] Inventors: Toshio Yutori, Takasago; Rikuo Ogawa, Kobe, both of Japan

[73] Assignee: Kabushiki Kaisha Kobe Seiko Sho, Kobe, Japan

[21] Appl. No.: 520,343

[22] Filed: Aug. 4, 1983

Related U.S. Application Data

[63] Continuation-in-part of Ser. No. 343,220, Aug. 4, 1983, abandoned.

[30] Foreign Application Priority Data

Jan. 27, 1981 [JP] Japan ..... 56-11031

[51] Int. Cl.[3] ..... C21D 8/06

[52] U.S. Cl. ..... 148/12 B; 148/12.4

[58] Field of Search ..... 148/12 B, 12.4, 36, 148/144; 75/123 J, 123 M

[56] References Cited

FOREIGN PATENT DOCUMENTS

| | | | |
|---|---|---|---|
| 141165 | 4/1980 | Fed. Rep. of Germany | 148/12.4 |
| 142455 | 6/1980 | Fed. Rep. of Germany | 148/12 B |
| 2238768 | 2/1975 | France | 148/12 B |
| 62120 | 5/1977 | Japan | 148/12 B |
| 6221 | 1/1978 | Japan | 148/12 B |
| 95819 | 8/1978 | Japan | 148/36 |
| 146218 | 12/1978 | Japan | 148/12 B |
| 1247 | 1/1979 | Japan | 148/12 B |
| 119134 | 9/1980 | Japan | 148/12 B |
| 119728 | 9/1981 | Japan | 148/12 B |
| 2088257 | 6/1982 | United Kingdom | 148/12 B |

*Primary Examiner*—Peter K. Skiff

*Attorney, Agent, or Firm*—Oblon, Fisher, Spivak, McClelland & Maier

[57] ABSTRACT

A process for producing steel wire or rod having high strength and ductility comprises the steps of (a) hot rolling a steel comprising 0.2–0.4%, by weight, of C, and 0.5–2.5%, by weight, of Mn, balance iron and inevitable impurities, while controlling the rolling conditions so that intermediate and final rolling temperatures are below 1000° C., and the total reduction ratio at temperatures below 930° C. is greater than 30%; thereby producing a steel consisting of work-hardened austenite having fine and uniform grains with an average austenite grain size of less than 25 μm; and (b) cooling said steel immediately after rolling to a temperature below 350° C. at an average cooling rate of 20°–250° C./sec, thereby forming a final phase in said steel of high ductility consisting essentially of martensite and a small amount of retained austenite.

The resulting steel has a martensitic structure and has high strength combined with high ductility. Up to 0.1% of Nb, up to 0.1% of V, up to 0.3% of Ti and up to 0.3% of Zr may be added to the alloy to further improve the ductility.

2 Claims, 10 Drawing Figures

PROCESS FOR PRODUCING STEEL WIRE OR RODS OF HIGH DUCTILITY AND STRENGTH

This application is a continuation-in-part of pending application Ser. No. 343,220 filed Aug. 4, 1983, now abandoned.

BACKGROUND OF THE INVENTION

1. Field of the Invention

This invention relates to a process for producing steel wire or rods having high ductility and high strength, and more particularly to a process for producing such rods having a tensile strength greater than 100 kg/mm$^2$ after rolling.

2. Description of the Prior Art

Increased strength in steel wire rods is generally achieved by forming a fine pearlite structure by means of a patenting treatment of a high carbon steel, followed by a wire drawing operation producing a large reduction of area. However, this method is applicable only to the production of wires of high strength and high ductility having small gages, since the ductility of the steel is influenced by the rod diameter at the time of patenting, and by the fact that the rods of larger gage can be wire drawn only to a limited extent while a large reduction of area in wire drawing is required for substantial enhancement of strength.

On the other hand, attempts have also been made to form a martensite structure, using a low carbon steel. A recent attempt has been made to produce a martensite structure by quenching a low carbon steel rod immediately after hot rolling in order to conserve energy.

However, such martensitic steel rods have the drawback that the quenched steel has a relatively low ductility and wire drawability, although a high strength can be achieved. The physical properties of martensitic steel rods of the prior art are shown in FIGS. 1–3. FIG. 1 illustrates the strength and ductility of a reheated and quenched wire rod (5.5 mm diameter) after water quenching, as a function of the C-content. It can be seen from this figure that increased strength of the martensite can be easily achieved by increasing the C-content, although the ductility deteriorates markedly and the reduction of area is decreased if the C-content exceeds 0.2%. Specimens having a C-content in excess of 0.25% fractured by yielding in a tensile strength test, and cracks extending along the length of the wire were clearly observed immediately after quenching when the C-content exceeded 0.35%. FIG. 2 shows the strength and ductility of a reheat-quenched wire rod which was subsequently tempered for one hour at 400° C. As can be seen from the figure, the ductility of the quenched wire rod is clearly restored by the tempering, but this is accompanied by a substantial drop in strength.

In current practice, it is conventional to draw a quenched rod into wire after tempering. FIG. 3 shows the relationship between the reduction of area and the tensile strength when a reheat-quenched 0.14% C carbon steel (a wire rod of 3.1 mm diameter) having a tensile strength of 132 kg/mm$^2$ after quenching, is subjected to wire drawing after restoration of ductility and wire drawability by tempering (tensile strength after tempering: 102 kg/mm$^2$). This figure also shows the relationship between the reduction of area and the tensile strength in a wire drawing operation for 0.8% C high carbon steel (a wire 5.5 mm in diameter) after patenting at 550° C. It can be seen that with martensitic steel wire which has been tempered for restoration of ductility and wire drawability, it is difficult to attain a strength comparable to that of the conventional high carbon steels. Any improvement in ductility by tempering a quenched wire rod seems to be related to a decrease in strength. That is, ther is an inverse relationship between the ductility and the strength in martensitic steel wire rods. The fracture stress, $\sigma_f$(true stress at the time of fracturing=fracturing load/area of fractured surface), which indicates a balance between ductility and strength, is about 170–190 kg/mm$^2$ for a quenched or tempered martensitic steel having a carbon content higher than 0.2%. Therefore, even if the carbon content is increased for the purpose of enhancing the strength, the ductility decreases with increasing strength within the range of constant $\sigma_f$. This can be seen in FIGS. 1 and 2. Consequently, in order to find a practical utility for high strength quenched steel having a carbon content greater than 0.2%, it is necessary to enhance the value of $\sigma_f$ by improving the essential properties of the martensite itself.

It can be seen from FIG. 4, which shows the relationship between the carbon content and the martensite transformation temperatures Ms=starting temperature; Mf=finishing temperature), that the transformation temperatures are lowered as the carbon content is increased. It is known in the art that cracking occures when steel of a low transformation temperature is quenched.

Accordingly, a need has continued to exist for steel wire and rod of a martensitic structure which has both high strength and good ductility.

SUMMARY OF THE INVENTION

Accordingly, it is an object of the present invention to provide a method for producing a martensitic steel wire or rod having high strength and good ductility.

A further object is prepare such a martensitic wire or rod by a process involving only hot rolling and cooling.

A further object is to provide a martensitic steel wire or rod having high strength and ductility which does not require a tempering step in its production.

Further objects of the invention will become apparent from the description of the invention.

The objects of the invention are attained by a process for producing steel wire or rod having high strength and ductility, which method comprises:

(a) hot rolling a steel containing 0.2–0.4%, by weight, of C and 0.5–2.5%, by weight, of Mn, balance iron and inevitable impurities, under such conditions of rolling that the intermediate and final rolling temperatures are lower than 1000° C. and the total reduction ratio at temperatures lower than 930° C. is greater than 30%, and thereby producing a steel consisting of work-hardened austenite having fine and uniform grains with an average austenite grain size of less than 25 $\mu$m.

(b) cooling the steel immediately after the rolling to a temperature below 350° C. at an average cooling rate of 20°–250° C./sec, thereby forming a final phase in said steel of high ductility consisting essentially of martensite and a small amount of retained austenite. The steel used in this process may optionally contain small amounts of additional elements amounting to less than 0.1%, by weight, of Nb, less than 0.1% by weight, of V, less than 0.3% by weight of Ti and less than 0.3%, by weight of Zr, singly or in combination.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DETAILED DESCRIPTION OF THE INVENTION AND PREFERRED EMBODIMENTS

Figure 1:
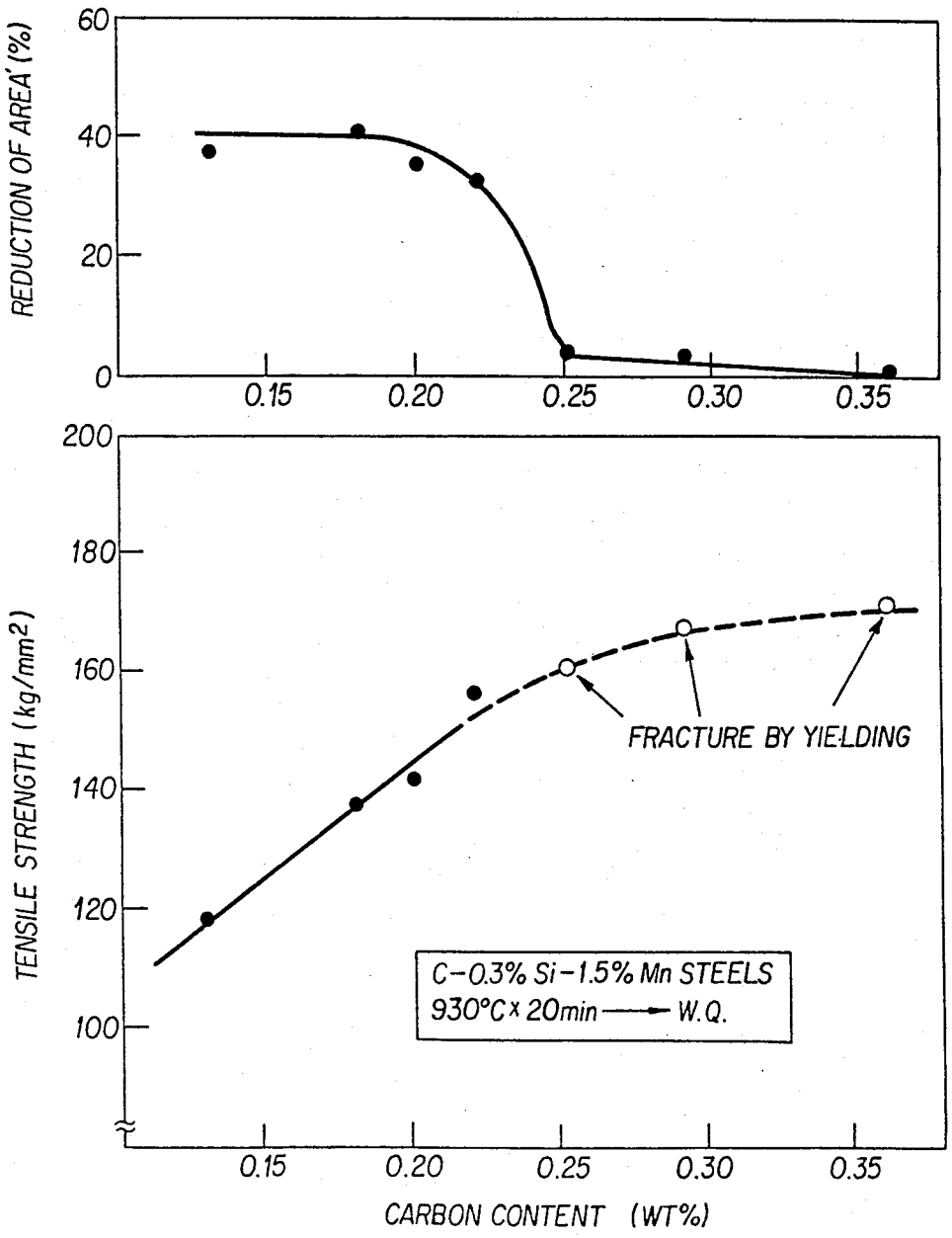
FIG. 1 is a diagram showing the tensile strength and the reduction of area after water quenching of a reheated and quenched wire rod (5.5 mm diameter) in relation to carbon content.
Figure 2:
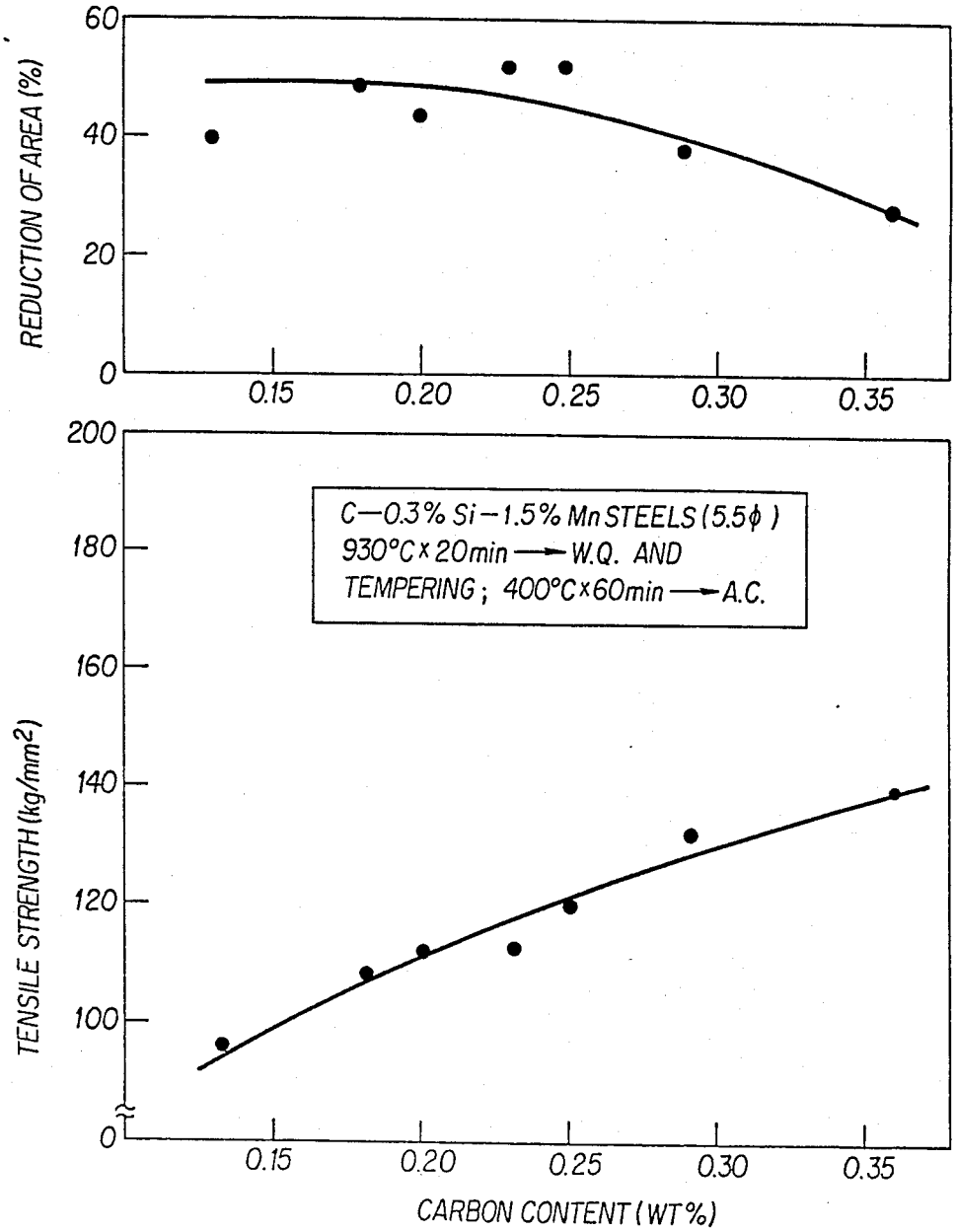
FIG. 2 is a diagram showing the tensile strength and the reduction of area of a wire rod after 400° C. × 60 min tempering.
Figure 3:
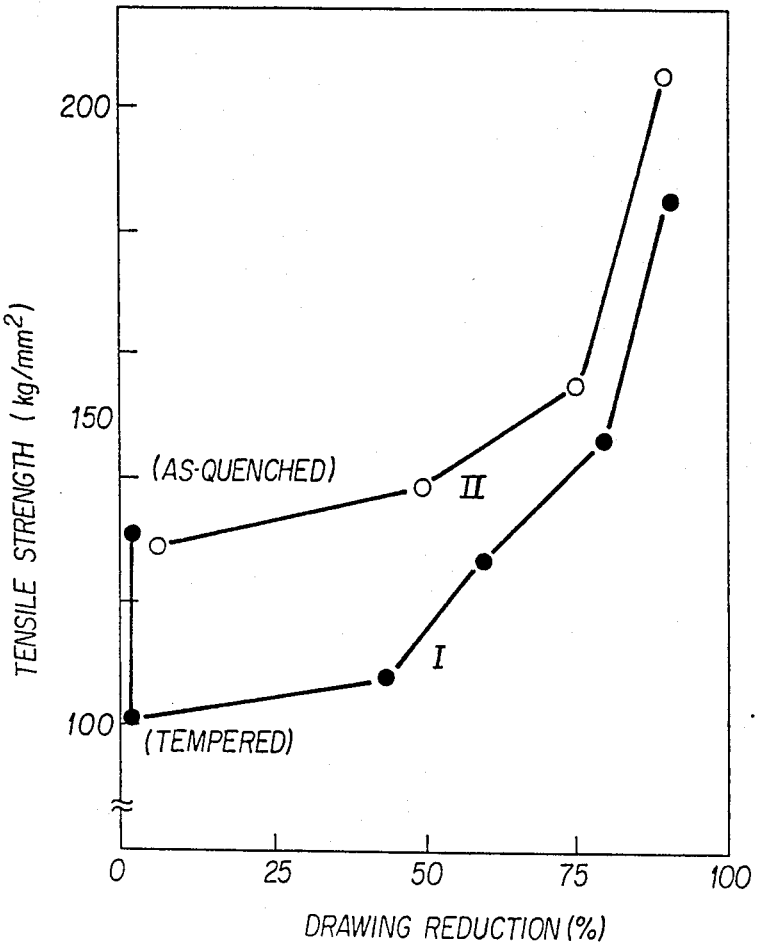
FIG. 3 is a diagram showing the relationship between the drawing ratio and the strength attained in wire drawing of a quenched and tempered material (I) of 0.14% C carbon steel and a patented material (II) of 0.8% C high carbon steel.
Figure 4:
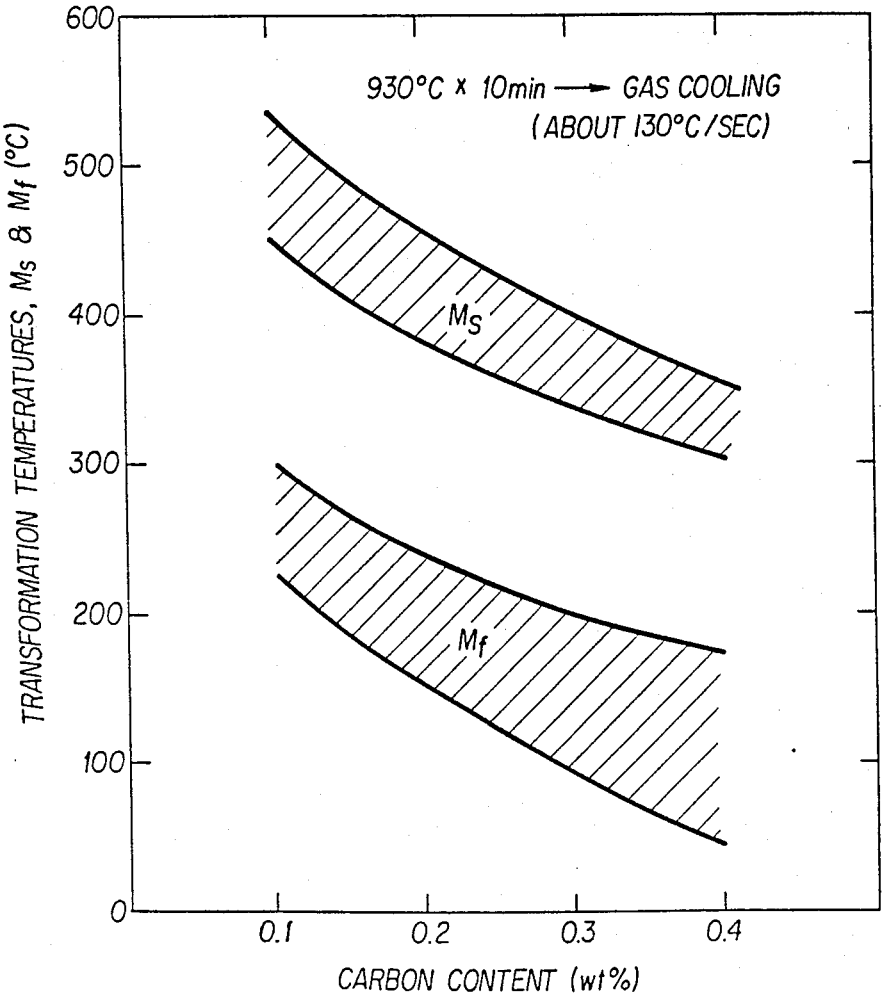
FIG. 4 is a diagram showing the relationship between carbon content and martensite transformation temperatures.

In the process of the present invention, it is essential to control the hot rolling conditions so that fine and uniform grains of austenite are produced during the rolling operation. The rolling conditions are adjusted to obtain low-temperature-rolled, work-hardened austenite of fine and uniform grains at the end of the rolling operation. Moreover, as the hot rolling operation is conducted to obtain work-hardened austenite of fine and uniform grains, it is clear that ferrite is not formed in the hot rolling operation. Immediately after rolling, the austenite having fine and uniform grains is quenched to produce a martensite steel wire or rod having high strength and ductility. No further tempering is necessary to enhance the ductility of the wire or rod produced by this process.

In the hot rolling step, the intermediate and final rolling temperatures should be lower than 1000° C., as it is difficult to form fine and uniform crystal grains of austenite by a rolling operation at higher temperatures. In rolling wire rod, especially in the last half of the rolling operation, including the intermediate and final rolling, the temperature of the rolled rod increases abruptly because of the increased deformation resistance resulting from lowered rolling temperature. Therefore, it is necessary to cool the wire rod during rolling by external means in order to control the temperature. Otherwise, i.e., in conventional rolling operations, the temperature of the wire rod can exceed 1000° C. If such a conventional rolling procedure is used in producing martensitic steel wire, a local coarsening of the austenite occurs. Consequently, the martensite derived from this austenite by the usual martensitic transformation does not have sufficiently fine grain. In subsequent operations involving extensive cold working, such as wire drawing, the deformation then tends to take place in certain locations, which causes wire fractures due to non-uniform deformation. Therefore, when the drawability of the wire is particularly important, the upper limit of the rolling temperature throughout the hot rolling operation is preferably lower than 1000° C. Furthermore, it is necessary to conduct the hot rolling operation so that the total reduction ratio at temperatures below 930° C. is greater than 30%, in order to obtain work-hardened austenite by introducing deformation strain into the individual fine and uniform austenite grains. These conditions have the synergistic effect of forming throughout the entire microstructure small size blocks of lath and its dislocation substructures, which are the constituent units of the lath-like martensite which is produced after cooling. These fine structures enhance the value of $\sigma_f$ and impart high strength and ductility to the wire rod upon cooling.

In the cooling stage subsequent to the rolling operation, it is necessary to cool the steel to a temperature below 350° C. at an average cooling rate of 20°–250° C./sec in order to produce the martensite transformation. The cooling speed and the ultimate cooling temperature are chosen depending upon the wire diameter, steel composition (e.g., hardenability, transformation temperature, etc.) and manufacturing process (e.g., production efficiency). It is desirable to employ as low a cooling rate as possible and as high an ultimate cooling temperature as possible in order to secure the best properties of strength and ductility, by forming martensite as the principal structure. These conditions of cooling speed and ultimate cooling temperatures also have the effect of preventing cracks from forming at the time of quenching.

In order to obtain a stable, high-strength steel containing 0.2–0.4% of carbon, the steel is subjected to cooling immediately after hot rolling in such a cooling method that the final phase structure becomes essentially complete martensite, with only a small amount of retained austenite.

The present invention not only considers the hardness of the steel at the end of the cooling stage, but also the toughness and ductility of the steel. The hot rolling of the steel is conducted so that fine and uniform grains of austenite, smaller than 25 μm in grain size, ASTM G.S. No. 8, are formed. If the average austenite grain size exceeds 25 μm, it is impossible to attain a high ductility. Accordingly, the average austenite grain size is less than 25 μm, preferably less than 20 μm. Further, where an average austenite grain size of less than 15 μm is used, a high ductility and an elongation value of more than 9%, can be achieved with a high cooling rate. Therefore, the average austenite grain size is especially preferred to be less than 15 μm.

The steel wire rod thus obtained is processed into the desired final product by wire drawing, blueing or other operations depending on the intended final purpose of the product.

With regard to chemical composition, the steel used in the process of the present invention should have a carbon content greater than 0.2%, by weight, in order to have an adequately high strength. However, it should be in the range of 0.2–0.4%, by weight, since a C-content in excess of 0.4% makes it difficult to obtain martensite of improved ductility in the cooling stage. Manganese should be present in a proportion of more than 0.5%, by weight, in order to increase the strength, but is should not exceed 2.5%, by weight, since too high a proportion of manganese causes difficulty in the melting step as well as a substantial lowering of the transformation temperature. Accordingly, the Mn-content should be in the range of 0.5–2.5%, by weight.

Besides the above-mentioned ingredients, the steel may contain Nb, V, Ti and Zr if circumstances require. These elements can improve the ductility of the steel by making its structure finer. For this purpose less than 0.1%, by weight, of Nb, less than 0.1%, by weight, of V, less than 0.3%, by weight, of Ti and less than 0.3%, by weight, of Zr are introduced singly or in combination. The steel wire rod produced by the method of the present invention is useful in diverse fields, for example, in the production of high tensile strength bolts, spring steels, hard steel wires, prestressed concrete (PC) steel wires, steel rods and the like. Therefore, depending on the selected utility of the ultimate product, less than 2%, by weight, of Si, less than 2%, by weight of Cr, less than 0.5%, by weight, of Mo, less than 8%, by weight, of Ni, less than 1%, by weight of Cu, less than 0.1%, by weight, of Al and less than 0.2%, by weight, of P may be added to the steel if desired.

Having generally described the invention, a more complete understanding can be obtained by reference to certain specific examples which are provided herein for purposes of illustration only and are not intended to be limiting unless otherwise specified.

EXAMPLE 1

The steel samples A to C of Table 1 were rolled after heating to 1100° C., while controlling the intermediate and final rolling temperatures below 980° C. and with a total reduction ratio of 63% (13.2 mm diameter) at temperatures below 930° C. Immediately after rolling, each sample was quenched to room temperature at an average cooling rate of 70°/sec. After cooling, test specimens were prepared, designated $A_1$, $B_1$ and $C_1$, respectively. Specimens $A_1$ and $B_1$ were then subjected to blueing for 2 min at 270° C., and the resulting steels were designated $A_2$ and $B_2$. Separately, specimen $B_1$ was subjected to light wire drawing at 20% reduction rate, followed by blueing for 2 min at 270° C. The resulting steel was designated specimen $B_3$.

Table 2 shows the mechanical properties of specimens $A_1$ to $B_3$. After cooling, a crack was clearly evident in specimen C.

For purposes of comparison, specimens A and C were rolled under the same conditions as mentioned above, except that the maximum temperature in the intermediate and final rolling stages was 1030° C. and the rolling was finished at a temperature above 930° C. Table 2 also shows the mechanical properties of the resulting specimens designated $A'_1$ and $B'_1$.

TABLE 1

| Steel | Chemical compositions (wt %) C | Si | Mn | Nb |
|---|---|---|---|---|
| A | 0.25 | 0.27 | 1.82 | — |
| B | 0.23 | 0.24 | 1.36 | 0.06 |
| C | 0.44 | 0.34 | 1.32 | <0.01 |

TABLE 2

| Specimen | Mechanical Properties Tensile strength (kg/mm²) | Total elongation (%)* | Reduction of area (%) | Stages passed | Finishing temperature (°C.) | Average Austenite Grain Size (μm) | ASTM G.S. No. |
|---|---|---|---|---|---|---|---|
| Invention | | | | | | | |
| $A_1$ | 189.2 | 13.7 | 48 | To cooling | 860 | 6.0 | 12.2 |
| $A_2$ | 175.4 | 13.1 | 63 | To blueing | — | — | — |
| $B_1$ | 182.8 | 12.9 | 45 | To cooling | 860 | 6.2 | 12.0 |
| $B_2$ | 174.8 | 12.6 | 60 | To blueing | — | — | — |
| $B_3$ | 221.7 | 6.8 | 57 | To wire draw- and blueing | — | — | — |
| Comparative Example | | | | | | | |
| $A'_1$ | 173.6 | 8.8 | 37 | To cooling | 960 | 29.0 | 7.6 |
| $A'_2$ | 145.4 | 7.5 | 48 | To blueing | — | — | — |
| $B'_1$ | 168.1 | 8.5 | 35 | To cooling | 960 | 32.3 | 7.3 |
| $B'_2$ | 144.7 | 7.3 | 47 | To blueing | — | — | — |
| $B'_3$ | 181.6 | 4.6 | 38 | To wire draw- and blueing | — | — | — |
| $C_1$ | — | — | — | To cooling** | 960 | 26.8 | 7.8 |

*Gage length: 8 × diameter of specimen
**Severe cracking occurred

As can be seen from Table 2, the wire rods produced by the method of the present invention have an excellent combination of strength and ductility at the end of the cooling stage and retain high ductility even after wire drawing and blueing. Also, inspection of Table 2 shows a much smaller average austenite grain size of the present invention than that of the comparative examples.

Figure 5:
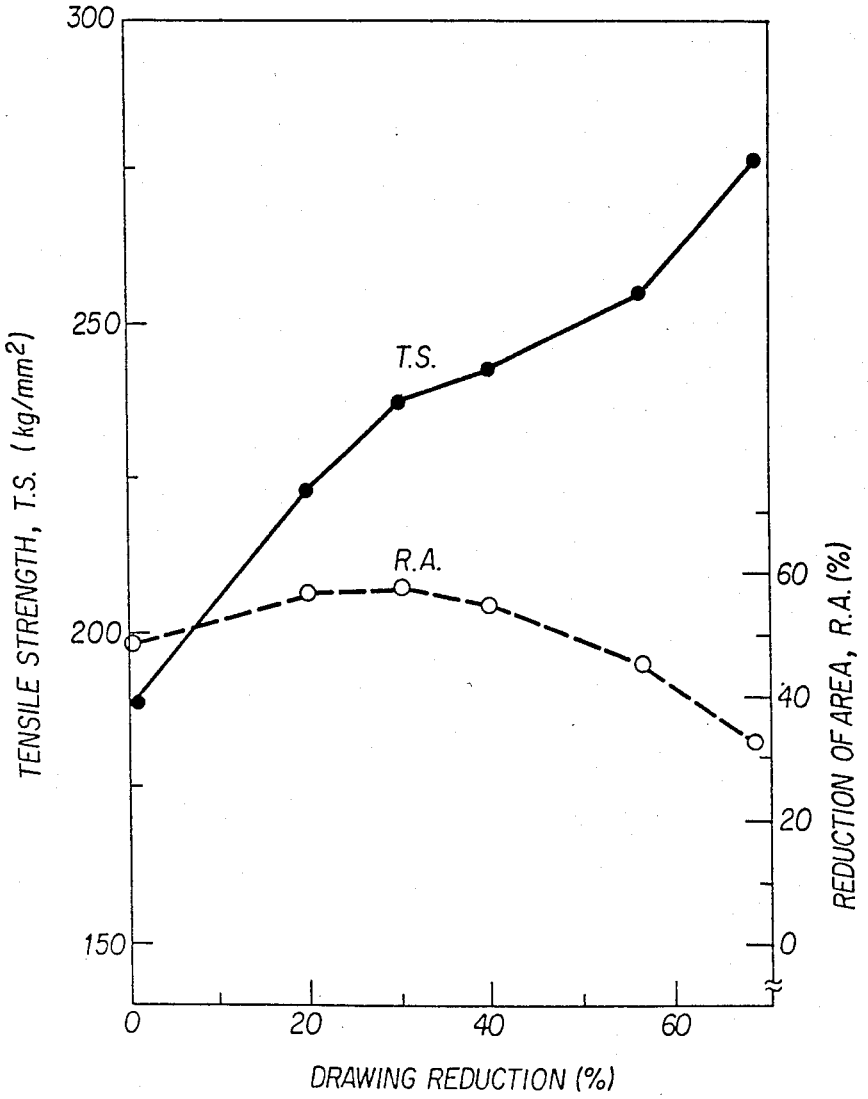
FIG. 5 is a diagram showing the relationship between the reduction of area, strength and drawing ratio in wire drawing a steel wire rod ($A_1$) obtained by the method of the prsent invention.
Figure 6:
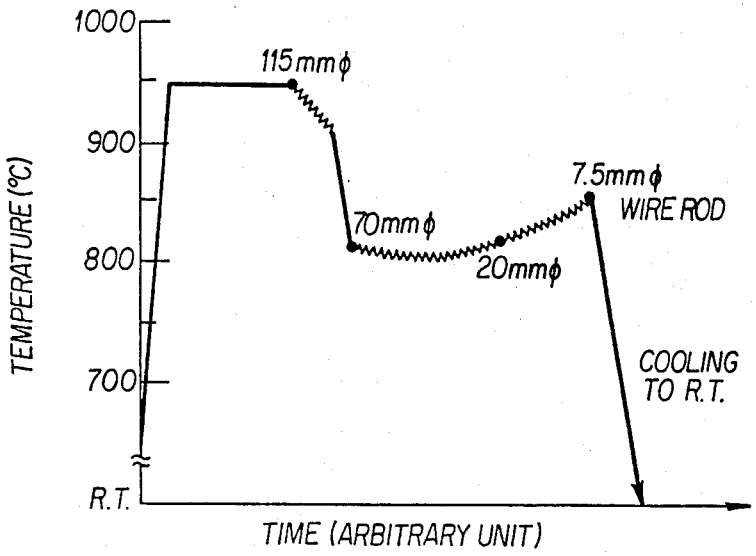
FIG. 6 is a diagram showing the rolling and cooling conditions according to the method of the invention as carried out in Example 2.

FIG. 5 shows the variations in strength and ductility (reduction of area) in cold wire drawing of the specimen $A_1$ described above. As can be seen from the figure, the wire rod prepared by the method of the present invention has satisfactory wire drawability and exhibits a marked increase in strength after wire drawing. In addition, the drawn wire retains a satisfactory ductility.

EXAMPLE 2

Figure 7:
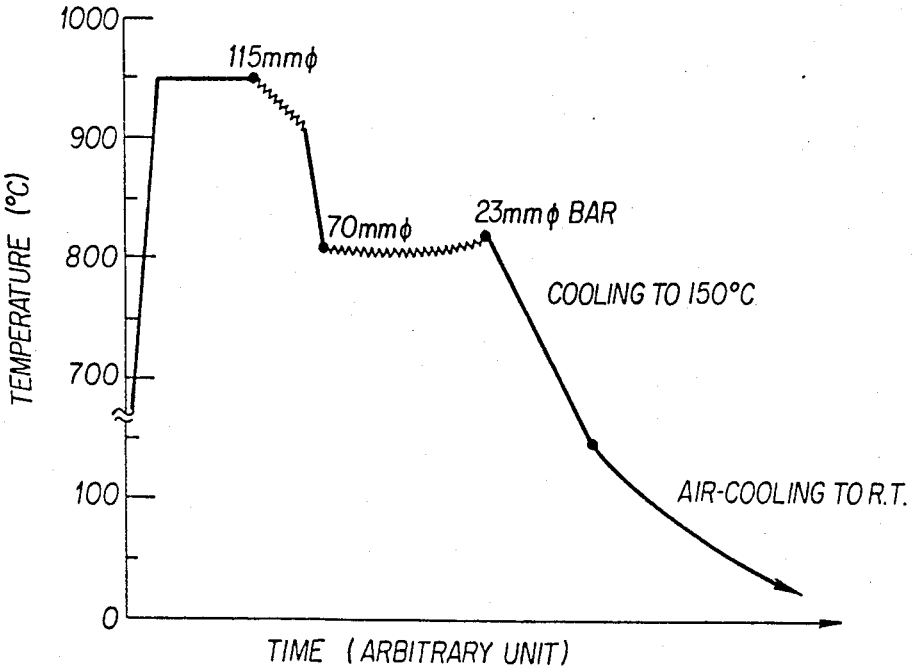
FIG. 7 is a diagram similar to FIG. 6, showing the rolling and cooling conditions for Example 3.

The steel sample D (115 mm square billet) of Table 3 was rolled after heating to 950° C., controlling the intermediate and final rolling temperatures below 860° C. as shown in FIG. 7, and with a total reduction ratio of about 98% at temperatures below 930° C. Immediately after rolling, the steel was cooled to room temperature at an average cooling speed of 150° C./sec. A steel test sample obtained at the end of the cooling stage was designated specimen $D_1$, while steel test samples which had been subjected to wire drawing after the cooling steps were designated specimens $D_2$ and $D_3$. The mechanical properties of specimens $D_1$ to $D_3$ are shown in Table 4. As can be seen from the table, the 7.5 mm diameter rod (in coil form) according to the present invention has high strength and excellent ductility, and the resulting hard steel wire rods have extremely high strength along with excellent ductility.

TABLE 3

| Steel | Chemical composition (wt %) C | Si | Mn | Cr | Nb |
|---|---|---|---|---|---|
| D | 0.26 | 0.23 | 1.63 | 0.02 | <0.01 |

TABLE 4

| Specimen | Wire diameter (mm) | Tensile strength ($kg/mm^2$) | Total* elongation (%) | Mechanical properties: Reduction of area (%) | Stages passed | Finishing temperature (°C.) | Average Austenite grain size (μm) | ASTM G.S. No. |
|---|---|---|---|---|---|---|---|---|
| $D_1$ | 7.5 | 183.9 | 10.6 | 51 | To cooling | 850 | 7.0 | 11.7 |
| $D_2$ | 5.8 | 225.2 | — | 48 | To 4% wire drawing | — | — | — |
| $D_3$ | 4.0 | 251.1 | — | 41 | To 72% wire drawing | — | — | — |

*Gage length: 8 × wire diameter

EXAMPLE 3

Figure 8:
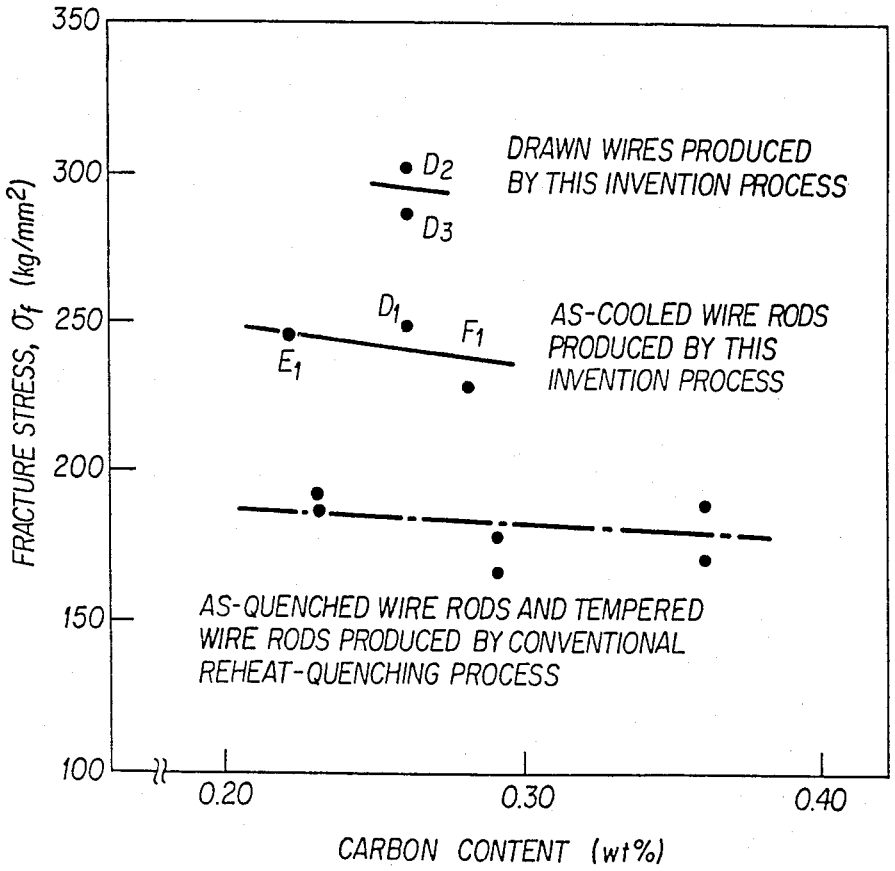
FIG. 8 is a diagram showing the relationship of the fracture stress and the carbon content in steels produced by various processes.
Figure 9:
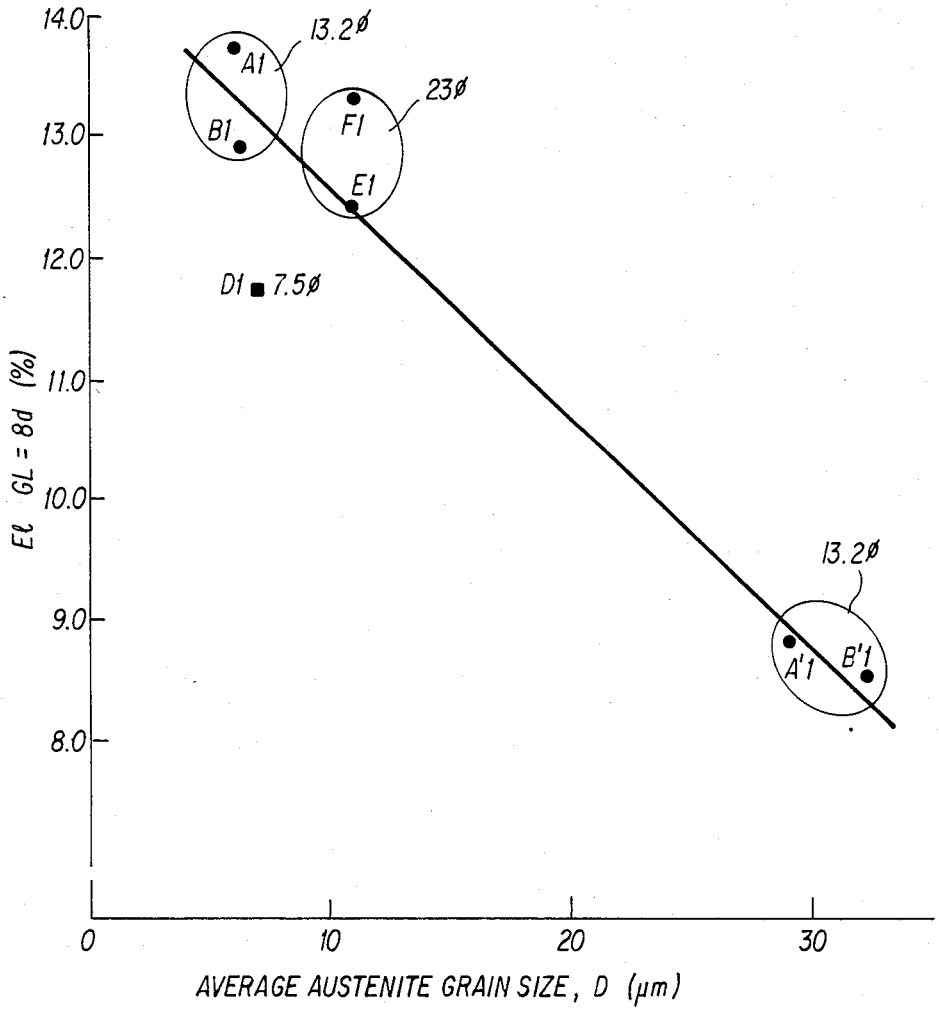
FIG. 9 illustrates the relationship between the elongation value, ElGL = 8d, and average austenite grain size, D in microns, after hot rolling and prior to cooling, wherein XX$^{\phi}$ means the wire diameter.
Figure 10:
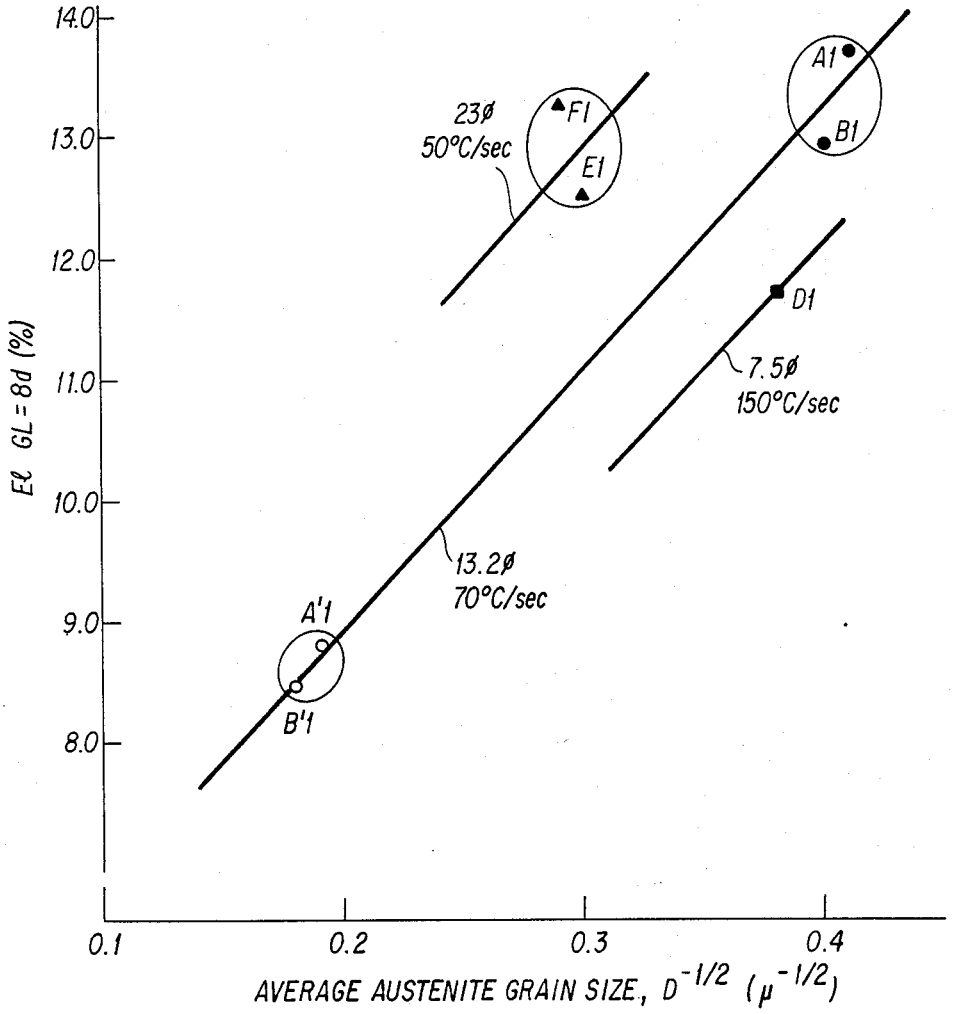
FIG. 10 illustrates the relationship between the elongation value ElGL = 8d, and average austenite grain size, $D^{-\frac{1}{2}}$ in microns, wherein XX$^{\phi}$ means the wire diameter and YY°C./sec means the cooling rate.

The steel samples E and F (115 mm square billets) of Table 5 were rolled after heating to 950° C., controlling the intermediate and final rolling temperatures below 820° C. as shown in FIG. 7, and with a total reduction ratio of about 91% at temperatures below 930° C. Immediately after the rolling, each sample was cooled to 150° C. at an average cooling rate of 50° C./sec, and then left to cool to ambient temperature. The mechanical properties of the cooled steel samples are shown in Table 6 as specimens $E_1$ and $F_1$, respectively. As can be seen from the the table, the steel rods according to the present invention have high strength and ductility already at the end of the cooling stage. The ductility of the wire rods can be enhanced further by tempering them. As is clear from FIG. 8, the improvements in the strength and ductility of the steel produced by the method of the present invention are attributable to the fine martensite structure which improves the balance between strength and ductility by improving the value of $\sigma_f$.

TABLE 5

| Steel | Chemical composition (wt %) C | Si | Mn | Cr | Nb |
|---|---|---|---|---|---|
| E | 0.22 | 0.25 | 1.32 | 0.28 | <0.01 |
| F | 0.27 | 0.24 | 1.68 | <0.02 | <0.01 |

TABLE 6

| Specimen | Wire diameter (mm) | Tensile strength ($kg/mm^2$)* | Total** elongation (%) | Mechanical properties: Reduction of area (%) | Stages passed | Finishing Temperature (°C.) | Average Austenite Grain Size (m) | ASTM G.S. No. |
|---|---|---|---|---|---|---|---|---|
| $E_1$ | 23 | 139.2 | 12.4 | 54 | To cooling | 835 | 11.0 | 10.4 |
| $F_1$ | 23 | 156.7 | 13.3 | 46 | To cooling | 835 | 11.5 | 10.3 |

*Wire diameter in tensile test: 9 mm
**Gage length: 8 × wire diameter

Having now fully described the invention, it will be apparent to one of ordinary skill in the art that many changes and modifications can be made thereto without departing from the spirit and scope of the invention as set forth herein.

What is claimed as new and sought to be protected by Letters Patent of the United States is:

1. A process for preparing a steel wire or rod having a tensile strength of greater than 140 $kg/mm^2$ and a total elongation of about 10.6% or greater, said method consisting of:

(a) hot rolling a steel consisting essentially of 0.2–0.4%, by weight, of C, and 0.5–2.5%, by weight, of Mn, with the balance iron and inevitable impurities, while controlling the rolling conditions so that intermediate and final rolling temperatures are below 1000° C., and the total reduction ratio at temperatures below 930° C. is greater than 30%; thereby producing a steel consisting of hardened austenite having fine and uniform grains, and (b) continuously cooling said steel immediately after rolling to room temperature at an average cooling rate of 20°–250° C./sec., thereby forming a final phase in said steel of high ductility consisting essentially of martensite and a small amount of retained austenite.

2. The process of claim 1 wherein said steel further contains at least one element selected from the group consisting of Nb, V, Ti and Zr, in amounts from an amount effective to improve the ductility of said martensitic steel rod up to less than 0.1%, by weight, of Nb, less than 0.1%, by weight, of V, less than 0.3%, by weight, of Ti and less than 0.3%, by weight, of Zr.

* * * * *